United States Patent [19]

Gardner et al.

[11] 4,311,100

[45] Jan. 19, 1982

[54] MULTI-SHELF DISPLAY STAND

[75] Inventors: Jeffrey M. Gardner, Wheaton; John R. Pieritz, Villa Park, both of Ill.

[73] Assignee: Container Corporation of America, Chicago, Ill.

[21] Appl. No.: 89,047

[22] Filed: Oct. 29, 1979

[51] Int. Cl.[3] ..... A47B 3/00; A47B 47/06

[52] U.S. Cl. ..... 108/111; 211/135; 211/149

[58] Field of Search ..... 108/111; 211/149, 135; 248/174; 229/29 B, 29 C; 206/44 R, 45, 45.33

[56] References Cited

U.S. PATENT DOCUMENTS

| | | | |
|---|---|---|---|
| 1,729,014 | 9/1929 | Scherotto | 248/174 X |
| 2,430,166 | 11/1947 | Fish et al. | 206/45 X |
| 2,688,408 | 9/1954 | Binggley | 206/45 X |
| 2,918,178 | 12/1959 | Leone | 248/174 X |
| 3,045,835 | 7/1962 | Hawthorne et al. | 108/111 X |
| 3,139,192 | 6/1964 | Maguire | 211/149 |
| 3,141,555 | 7/1964 | Funke et al. | 211/135 |
| 4,271,766 | 6/1981 | Schmiedler | 108/11 |

*Primary Examiner*—James T. McCall

*Attorney, Agent, or Firm*—R. W. Carpenter; Davis Chin

[57] ABSTRACT

A multi-shelf display stand formed from a paperboard tube.

2 Claims, 3 Drawing Figures

MULTI-SHELF DISPLAY STAND

SUMMARY OF THE INVENTION

This invention relates to display stands and more particularly to a multi-shelf display stand formed from a unitary blank of foldable paperboard.

It is an object of the invention to provide a display stand of the type described which can be formed from a tubular construction.

A more specific object of the invention is the provision of a multi-shelf display stand of the type described having novel gusset means for joining the ends of the shelves to the side walls of the stand in such a manner that will permit the stand to be erected from a tubular blank.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 3:
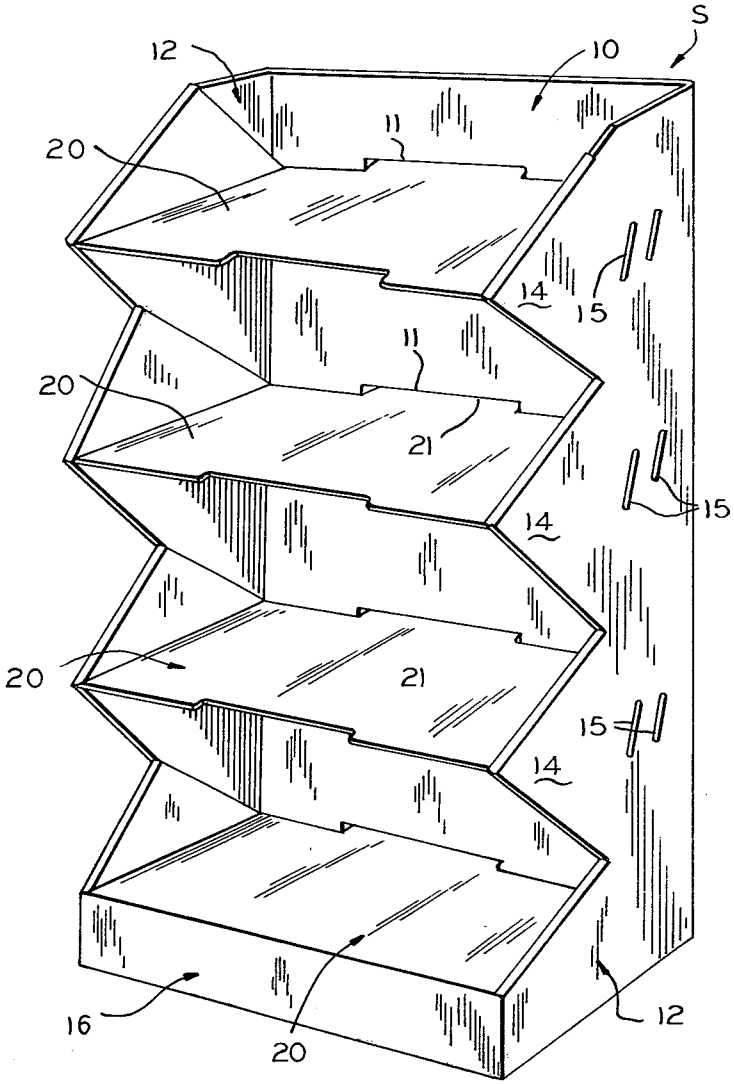
FIG. 3 is a perspective view of the stand as shown in the completely erected condition.

Referring now to the drawings for a better understanding of the invention, it will be seen that the novel multi-shelf display stand, indicated generally at S in FIG. 3, may be formed from a unitary blank B of foldable sheet material, such as paperboard, illustrated in FIG. 4.

The display stand is designed and constructed to be assembled or erected from a tubular blank of paperboard which is shipped to the user in collapsed condition so that it can be quickly assembled.

The stand includes front and rear walls, a pair of opposed side walls, and a plurality of shelves extending between the side walls.

The rear wall 10 of the stand comprises a primary panel **10*a* and a relatively narrow glue panel 10*b* which may be secured together in overlapping relation in any desired manner, such as stapling, taping, or adhesive. Primary panel 10*a* is provided with a plurality of vertically spaced, laterally extending slots 11** adapted to receive portions of shelves in a manner explained later in the specification.

A pair of spaced parallel side walls 12 are foldably joined at their rear edges along fold lines 13 to opposed side edges of rear wall 10 and extending forwardly therefrom. Side walls 12 each present a plurality of forwardly extending projections 14 presenting sloping edges. Each of the side walls 12 may be provided with a plurality of slots 15 for use in receiving the the ends of support bars (not shown) if additional support for the shelves is desired.

Lower portions of side walls 12 are interconnected by a relatively narrow front wall 16 which is foldably joined at its side edges along fold lines 17 to front edges of the respectiveside walls.

Figure 1:
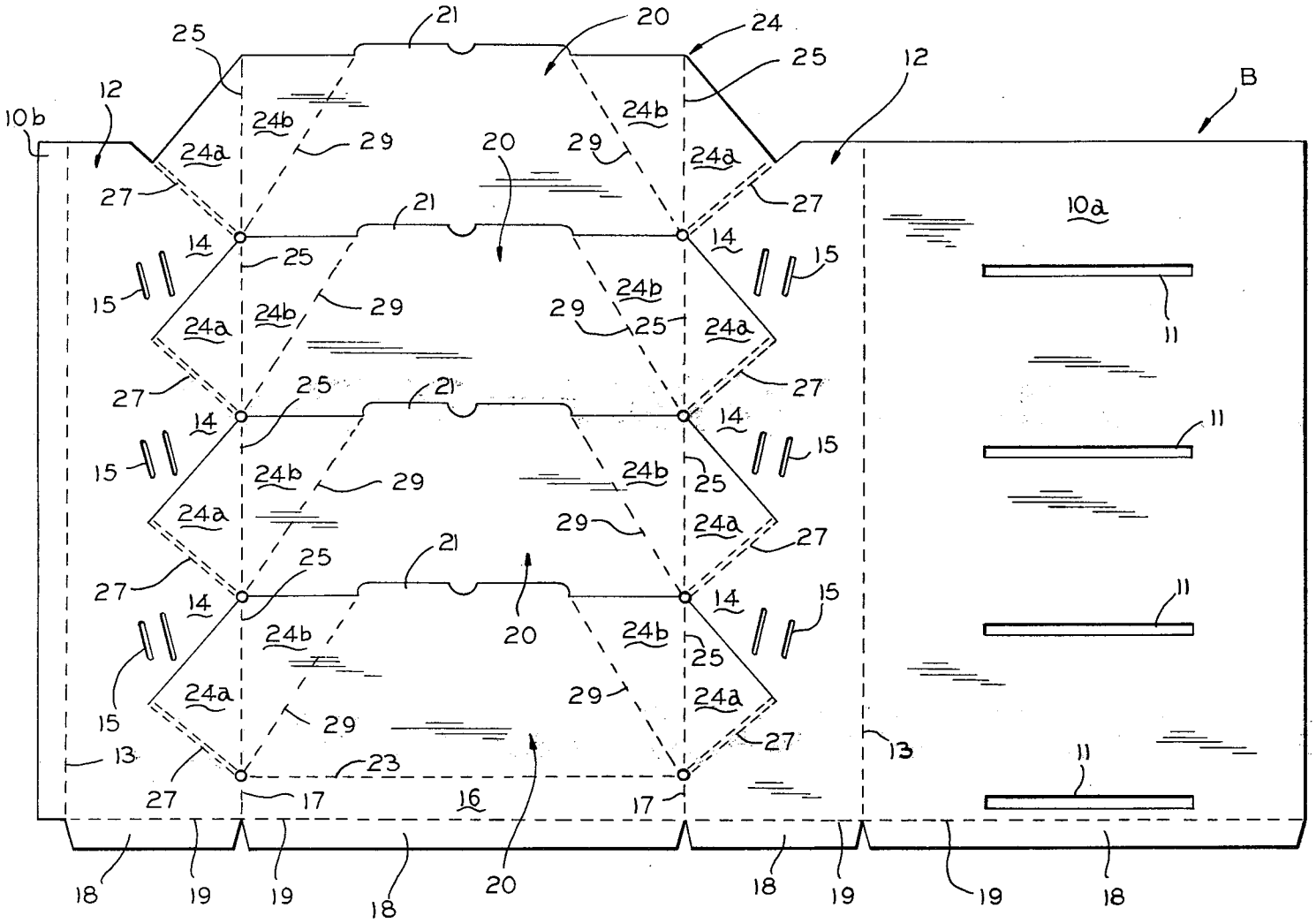
FIG. 1 is a plan view of a blank of foldable sheet material from which the stand embodying features of the invention and illustrated in the other views may be formed.
Figure 2:
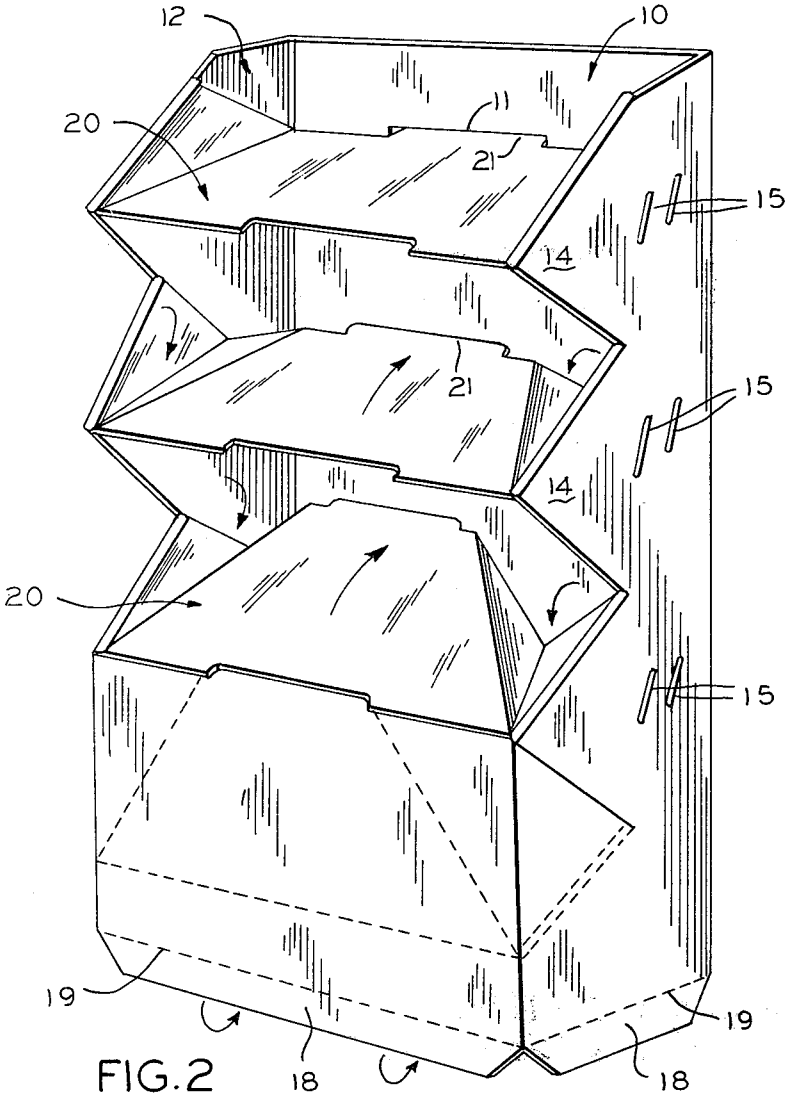
FIG. 2 is a perspective view illustrating one step and in the manner of erecting the carton from the blank illustrated in FIG. 1.

As best seen in FIGS. 1 and 2, there may be provided a plurality of relatively narrow elongated bottom flanges 18 which are foldably joined to the respective wall panels along fold lines 19. The purpose of the bottom flanges, which are folded inwardly and normal to their related walls when the stand is erected, is to help maintain the stand in a square shape.

The essential features of the invention reside in the provision of a plurality of vertically spaced, laterally extending shelf panels 20 and particularly in the manner in which they are joined at their ends to the side walls of the stand. All of the shelf panels 20 are provided with rearwardly extending projections 21 which are adapted to be received within slots 11 of rear wall 10 when the container is in erected condition. If desired, the lowermost shelf panel 20, as illustrated in the drawing, may be foldably joined at its forward edge along fold line 23 to the upper edge of front wall 16.

The opposed ends of each of the shelf panels 20 are foldably joined to the respective side walls 12 by means of novel gusset members 24, each of which includes a pair of generally triangular gusset elements **24*a* and 24*b* which are foldably joined to each other along a common fold line 25**.

As best seen in FIG. 1, each of the gusset elements **24*a* is foldably joined at one side edge along fold line 27 to an adjacent projection 14 of a related side wall. Each of the gusset arrangements 24*b* is formed from material of related shelf panel 20 and is foldably joined thereto along a diagonal fold line 29**.

To assemble the stand, after the ends of the blank have been connected to form a tube, the center portions of the shelf panels 20 are held in position while the gusset arrangements are folded downwardly so that the gusset arrangements **24*a* can be folded into face-to-face relation with adjacent surfaces of the related side walls 12. Then as the shelf panels folded in a position normal to the rear wall of the stand, the gusset elements 24*b* are folded back into the planes of their related shelf panels. As this is done, shelf panel projections 21 are inserted into slots 11 of rear wall 10. The bottom flanges 18** are then folded downwardly at right angles to their respective walls. If desired, support bars (not shown) may be inserted in corresponding slots of opposed side walls to provide additional support for the shelves.

Thus, it will be understood that the invention provides a novel construction which permits blanks for display stands to be shipped in tubular collapsed condition and to be easily and quickly assembled because of the novel gusset means attaching the ends of the shelves to the side walls of the stand.

We claim:

1. A multi-shelf, vertical display stand, formed of a unitary tube of foldable paperboard, comprising:

(a) a rear wall having a primary panel and a relatively narrow panel adapted to be secured to said primary panel in overlapping relation to form a unitary tube;

(b) a pair of opposed side walls foldably joined at their rear edges to opposed side edges of said rear wall and extending forwardly therefrom;

(c) each of said side walls presenting a plurality of sloping edges;

(d) a plurality of shelf panels extending normally between said side walls, said shelf-panels having a depth substantially equal to the width of said side walls, each of said shelf panels having a rearwardly extending projection adapted to be received within respective slots disposed in said rear wall;

(e) gusset means foldably joining opposed ends of each of said shelf panels to adjacent sloping edges of respective side walls;

(f) each of said gusset means including a pair of generally triangular gusset elements foldably joined to each other along a common fold line and being adapted to fold inwardly therealong to lie in the plane of said side walls with:

(i) one of said gusset elements being foldably joined along a first diagonal fold line to an adjacent sloping edge of a related side wall and disposed in face to face relation therewith;

(ii) the other of said gusset elements being formed from material of a related shelf panel and being foldably joined thereto along a second diagonal fold line to accommodate the erection of said display stand from said tube.

2. A structure, for retaining or displaying articles, formed of a unitary tube of foldable paperboard, comprising:

(a) a base wall having a primary panel and a relatively narrow panel adapted to be secured to said primary panel in overlapping reltion to form a unitary tube;

(b) a pair of opposed side walls foldably joined at corresponding edges to opposed side edges of said base wall and extending therefrom;

(c) each of said side walls presenting at least one sloping edge;

(d) a panel extending normally between said side walls, said panel having a depth substantially equal to the width of said side walls, said panels having a rearwardly extending projection adapted to be received within a slot disposed in said rear wall;

(e) gusset means foldably joining opposed ends of said panel to adjacent sloping edges oif related side walls;

(f) each of said gusset means including a pair of generally triangular gusset elements foldably joined to each other along a common fold line and being adapted to fold inwardly therealong to lie in the plane of said side walls with:

(i) one of said gusset elements being foldably joined along a first diagonal fold line to an adjacent sloping edge of a related side wall and disposed in face-to-face relation therewith;

(ii) the other of said gusset elements being formed from material of said panel and being foldably joined thereto along a second diagonal fold line to accommodate the erection of said structure from said tube.

* * * * *